US011377906B2

(12) United States Patent
Jang

(10) Patent No.: US 11,377,906 B2
(45) Date of Patent: Jul. 5, 2022

(54) CORDLESS BLIND DEVICE FOR EXTERNAL POWER DRIVE

(71) Applicant: WINTEC KOREA INC., Gwangju-si (KR)

(72) Inventor: Seong-Ryong Jang, Seoul (KR)

(73) Assignee: WINTEC KOREA INC., Gwangju-si (KR)

( * ) Notice: Subject to any disclaimer, the term of this patent is extended or adjusted under 35 U.S.C. 154(b) by 54 days.

(21) Appl. No.: 16/959,724

(22) PCT Filed: Jan. 4, 2019

(86) PCT No.: PCT/KR2019/000164
§ 371 (c)(1),
(2) Date: Jul. 2, 2020

(87) PCT Pub. No.: WO2019/135638
PCT Pub. Date: Jul. 11, 2019

(65) Prior Publication Data

US 2020/0362629 A1 Nov. 19, 2020

(30) Foreign Application Priority Data

Jan. 8, 2018 (KR) ..... 10-2018-0002498

(51) Int. Cl.
*E06B 9/74* (2006.01)
*E06B 9/42* (2006.01)
*E06B 9/60* (2006.01)

(52) U.S. Cl.
CPC ..... *E06B 9/74* (2013.01); *E06B 9/42* (2013.01); *E06B 9/60* (2013.01)

(58) Field of Classification Search
CPC ..... E06B 9/74; E06B 9/42; E06B 9/60
USPC ..... 160/312
See application file for complete search history.

(56) References Cited

U.S. PATENT DOCUMENTS

2010/0269984 A1* 10/2010 Hanley ..... E06B 9/76 160/84.04
2017/0008191 A1 1/2017 Foley et al.
2019/0352963 A1* 11/2019 Jang ..... E06B 9/40

FOREIGN PATENT DOCUMENTS

KR 10-2014-0065430 A 5/2014
KR 20-0480955 Y1 7/2016
KR 10-1774567 B1 9/2017
KR 10-1808278 B1 12/2017

* cited by examiner

*Primary Examiner* — Beth A Stephan
(74) *Attorney, Agent, or Firm* — Novick, Kim & Lee, PLLC; Jae Youn Kim

(57) ABSTRACT

A cordless blind device for external power drive is provided. The cordless blind device comprises: a winding roll; a screen member wound or unwound on the winding roll; a weight member connected to the lower end of the screen member to apply a torque in the direction in which the screen member is unwound; an elastic member for applying an elastic force to the winding roll to apply a torque in the direction in which the screen member is wound; and a power conversion module formed on at least one of the fixing brackets, and including a first driving shaft connected to the winding roll, a second driving shaft exposed to the outside of the fixing bracket and connected to a driving device connecting hole, and a gear box for transmitting power in both directions between the first driving shaft and the second driving shaft.

8 Claims, 7 Drawing Sheets

CORDLESS BLIND DEVICE FOR EXTERNAL POWER DRIVE

TECHNICAL FIELD

The present invention relates to a cordless blind device for external power drive and, more particularly, a cordless blind device for external power drive, the cordless blind device being able to be conveniently operated by directly moving a screen without a cord and being able to be operated by separate external power.

BACKGROUND ART

A blind device is installed to block direct sunlight passing through a window or gaze from the outside. It is possible to make a more comfortable indoor mood from soft glow effect by appropriately adjusting the amount of light using a blind device. A blind device is installed over a window and has a structure that can be opened/closed.

A blind device may include a screen that is wound or unwound in a form of a roll. It is possible to open a portion or the entire of a window and adjust the amount of light by adjusting the size of the screen. In such a roll type blind device, it is possible to adjust the size of the screen using a cord (pulling string) that rotates the roll.

That is, existing blind devices are formed such that a user can easily rotate a roll installed at the top of a window by applying tension by pulling down a cord. However, according to this structure, force is concentrated only on the side connected with the cord, so there is a problem that blind devices are unbalanced or the joint between the roll and the cord is easily broken when it is repeatedly used.

Further, when a cord is hung down too long, people, particularly, careless children easily trip on it, so there is a high possibility of a safety accident. Further, it is required to rotate the entire roll while maintaining balance with a cord connected to a side of the roll, so there are many problems with the driving structure using a cord, such as an unnecessarily complicated rotation structure, and the problems need to be resolved.

Further, when a cord is not used to solve the problems and a blind device is installed high over a window, it may be difficult to operate the blind device due to problems such as people cannot reach the blind device, these problems also need to be resolved.

CITATION LIST

Patent Literature

[Patent Literature 1]
Korean Utility Model No. 20-0480955 (2016.07.29)

SUMMARY OF INVENTION

Technical Problem

The present invention has been made in an effort to solve the problems, and an object of the present invention is to provide a cordless blind device for external power drive, the cordless blind device being able to be conveniently operated by directly moving a screen without a cord and being able to be operated by separate external power.

The object of the present invention is not limited to those described above, and other objects may be made apparent to those skilled in the art from the following description.

Solution to Problem

A cordless blind device for external power drive of the present invention includes: a winding roll rotatably coupled to a pair of fixing brackets disposed at both ends, respectively; a screen being wound on or unwound from the winding roll; a weight connected to a lower end of the screen and applying torque in a first direction in which the screen is unwound from the winding roll by gravity; an elastic member applying torque in a second direction in which the screen is wound by applying elasticity to the winding roll; and a power conversion module disposed in at least one of the pair of fixing brackets and including a first driving shaft connected to the winding roll, a second driving shaft exposed outside the fixing bracket and connected with a driving device connector, and a gear box connecting the first driving shaft and the second driving shaft and transmitting power in two directions.

The first driving shaft may be coaxially disposed with the winding roll, and the second driving shaft may extend downward from the fixing bracket.

The first driving shaft and the second driving shaft may perpendicularly cross each other.

The gear box may include a pair of bevel gears.

The driving device connector may have a tool insertion groove recessed coaxially with the second driving shaft.

An end connected to the first driving shaft of the gear box may be inserted in the winding roll and the other end connected to the second driving shaft may be positioned in the fixing bracket.

The gear box may generate resistance that offsets a resultant force of torque applied to the winding roll in the first direction and torque applied to the winding roll in the second direction.

The magnitude of the resistance may be adjusted by adjusting a gap between gears in the gear box.

The elastic member may be a torsional elastic member keeping elastic energy by elastically deforming with rotation of the winding roll.

The torsional elastic member may be a coil spring fitted on an outer side of a rotary shaft connected to the winding roll.

The cordless blind device may further include a driving device separably coupled to the driving device connector and providing a driving force to the second driving shaft.

Advantageous Effects of Invention

According to the present invention, there is no cord for operating the screen, so it is possible to remarkably reduce the possibility of a negligent accident of children and it is possible to simply adjust the height of the screen without a cord.

Further, since the cordless blind device can be operated by power provided from the outside using a separate tool, it is possible to operate the screen even at a height that is not reached by a hand. In particular, since it is possible to conveniently operate the screen using common electric tools that are generally used at home, it is possible to achieve a blind device that is electrically operated without additional cost.

Further, since it is possible to use simple manual tools in addition to electric tools, it is possible to vary external power that is applied, depending on the situation of user.

DESCRIPTION OF EMBODIMENTS

Figure 1:
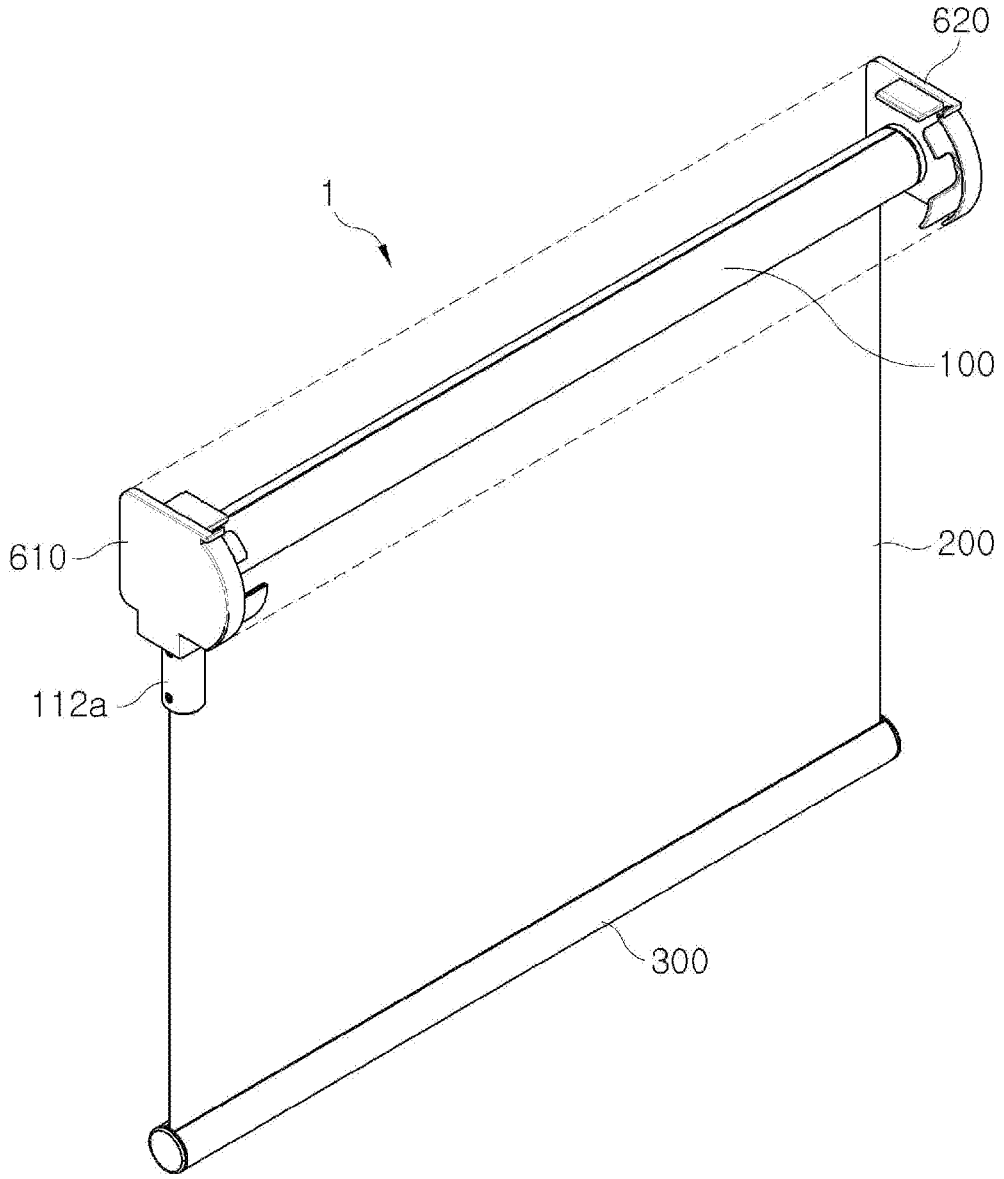
FIG. 1 is a perspective view of a cordless blind device for external power drive according to an embodiment of the present invention.

The advantages and features of the present invention, and methods of achieving them will be clear by referring to the exemplary embodiments that will be described hereafter in detail with reference to the accompanying drawings. However, the present invention is not limited to the exemplary embodiments described hereafter and may be implemented in various ways, and the exemplary embodiments are provided to complete the description of the present invention and let those skilled in the art completely know the scope of the present invention. The present invention is defined by claims. Like reference numerals indicate the same components throughout the specification.

Hereafter, a cordless blind device according to an embodiment of the present invention will be described in detail with reference to FIGS. 1 to 7.

Figure 2:
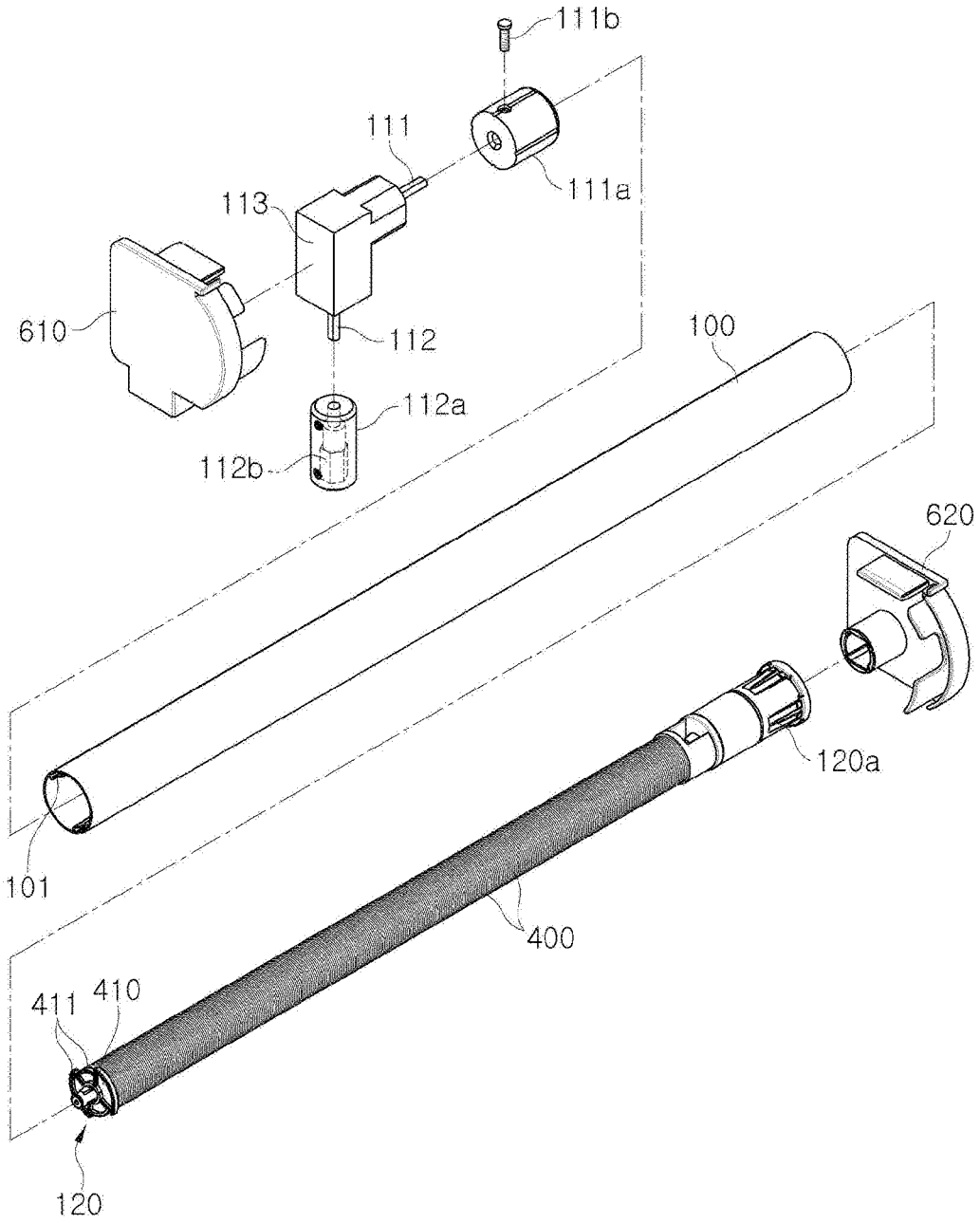
FIG. 2 is an exploded perspective view of a winding roll of the blind device shown in FIG. 1.
Figure 3:
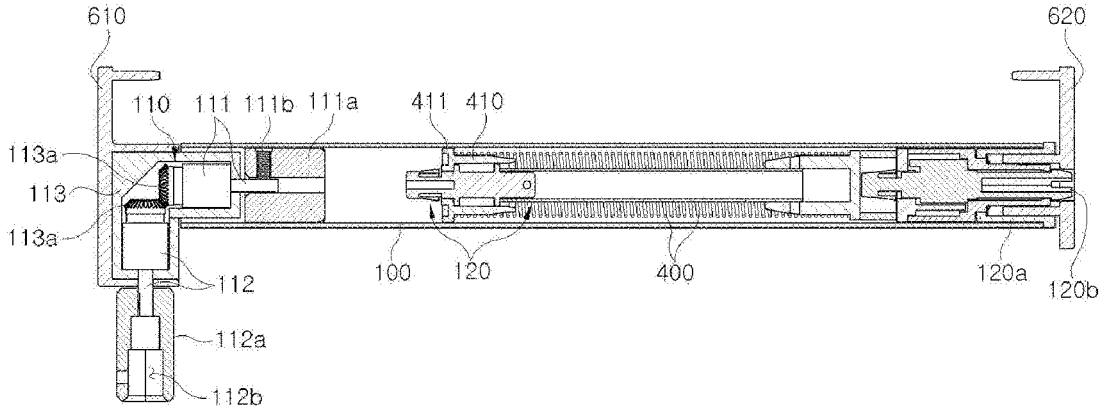
FIG. 3 is a cross-sectional view showing the internal structure of the winding roll of the blind device shown in FIG. 1.

FIG. 1 is a perspective view of a cordless window blind according to an embodiment of the present invention, FIG. 2 is an exploded perspective view of a winding roll of the blind device shown in FIG. 1, and FIG. 3 is a cross-sectional view showing the internal structure of the winding roll of the blind device shown in FIG. 1. The screen shown in FIG. 1 is not shown in FIG. 2 and to more clearly show the mechanical structure.

Referring to FIGS. 1 to 3, a cordless blind device 1 for external power drive according to an embodiment of the present invention (hereafter, referred to as a cordless blind device), as shown in the figures, has a very simple external shape without a cord (pulling string). The cordless blind device 1 is designed to maintain balance using its own elasticity, so it can be very simply operated in an automatic or semiautomatic type. If necessary, it has a convenient function, that is, it can be operated by a driving force provided from the outside of the device. That is, the cordless blind device 1 of the present invention can be conveniently operated even without a cord because the elasticity and the weight of the components of the device are equilibrated, and if necessary, it can be operated by a driving force provided from a separate external driving device. In particular, even if the blind device is installed high and a person has difficulties to directly touch it, the blind device has an advantage that it can be very conveniently operated using a separate driving device.

The cordless blind device 1 is easily operated even without a cord by rotational forces (torque) that are applied to the winding roll 100 in opposite directions. The rotational force is generated in a pair by an elastic member (see 400 in FIGS. 2 and 3) connected to the winding roll 100 and the weight of a screen 200 being wound on or unwound from the winding roll 100 and a weight 300 connected to the screen 200. The rotational forces (torque) generated in a pair are increased or decreased while maintaining balance depending on the unwound length of the screen 200. Since the rotational forces (first-directional torque (see T1 in FIGS. 5 and 6) and second-directional torque (see T2 in FIGS. 5 and 6) generated in a pair are equilibrated but act in opposite directions, it is possible to easily break the equilibrium by applying a minimum external force (which can be easily transmitted by touching the screen or the weight) and easily restore the equilibrium by removing the external force. Accordingly, it is possible to rotate the winding roll 100 by applying external force in a desired direction or stop the winding roll 100 at the rotated position by removing the external force.

Further, there may be a subtle difference between the magnitudes of torque due to reasons related to the structure, design, and manufacturing process, but it is possible to solve this problem by generating resistance using a power conversion module 100 connected to the winding roll 100. That is, it is possible to more easily maintain a stop status by offsetting the resultant force of opposite torque with resistance of the power conversion module 110. The resistance of the power conversion module 110 acts in a direction in which a motion is stopped by friction generated in a driving structure included in the power conversion module 110, whereby it is possible to prevent undesired rotation of the winding roll 100 and easily maintain the stop status until an appropriate external force is transmitted. As described above, by the structure using the pair of rotational forces acting in opposite directions and resistance such as friction force, it is possible to very conveniently operate the blind device even without a cord.

Further, since the power conversion module 110 transmits an external driving force to the winding roll 100 by connecting the winding roll 100 to an external driving device (see A in FIG. 7), it is possible to automatically operate the blind device by providing a rotational force to the winding roll 100 using the external driving device. In particular, when the blind device is operated by the external driving device, it is possible to very conveniently operate the blind device by connecting a driving device, etc., to the power conversion module 110 even if the blind device is installed at a relatively high position that a person has difficulties in directly touching. The external driving device may be provided together with the blind device, but it is possible to directly use electric tools at home as the external driving device, so it is possible to more conveniently operate the cordless blind device 10 of the present invention using various tools.

The cordless blind device for external power drive, in detail, includes: a winding roll 100 rotatably coupled to a pair of fixing brackets 610 and 620 disposed at both ends, respectively; a screen 200 being wound on or unwound from the winding roll 100; a weight 300 connected to the lower end of the screen 200 and applying torque in a first direction in which the screen 200 is unwound from the winding roll 100 by gravity; an elastic member 400 applying torque in a second direction in which the screen 200 is wound by applying elasticity to the winding roll 100; and a power conversion module 110 disposed in at least one of the pair of fixing brackets 610 and 620 and including a first driving shaft 111 connected to the winding roll 100, a second driving shaft 112 exposed outside the fixing bracket 610 and connected with a driving device connector 112*a*, and a gear box 113 connecting the first driving shaft 111 and the second driving shaft 112 and transmitting power in two directions. The cordless blind device 1 having this characteristic is described hereafter in more detail with reference to the drawings.

The winding roll 100 is formed in a cylindrical shape. The winding roll 100 may be formed in a hollow cylindrical shape, as shown in FIGS. 1 to 3. The winding roll 100 may be disposed between fixing brackets 610 and 620 to which a rotary shaft is fixed, and the fixing brackets 610 and 620 may be combined with a housing (indicated by dotted lines in FIG. 1) that keeps the winding roll 100 therein. Since the winding roll 100 is hollow, the rotary shaft can be inserted in the winding roll 100. Further, the elastic member 400 and the power conversion module 110 can also be inserted in the winding roll 100. However, the winding roll 100 is not necessarily limited to a cylindrical shape, and at least a portion of the winding roll 100 may be changed in an appropriate shape that easily winds or unwinds the screen 200. The winding roll 100 may be rotatably coupled to a shaft structure having various shapes and rotatably supporting the winding roll 100.

The shaft structure rotatably supporting the winding roll 100 may include the driving shaft (first driving shaft 111) of the power conversion module 110 and a rotary shaft 120 connected to the elastic member 400. As in an embodiment of the present invention, these components may be coupled to and rotatably supported at both ends of the winding roll 100. By separately coupling the shaft structure to different ends, it is possible to more efficiently use the internal space of the winding roll 100. However, the present invention is not limited thereto, and shaft structures that can rotatably support the winding structure in various ways may be used.

The screen 200 is wound on or unwound from the winding roll 100. The screen 200 can be wound on the winding roll 100 or unwound from the winding roll 100 when the winding roll 100 is rotated. An end of the screen 200 may be connected to the winding roll 10 to rotate with the winding roll 100 and the other end may be connected and fixed to the weight 300. Assuming that the screen 200 is unwound when the winding roll 100 is rotated in a predetermined direction, the screen 200 can be wound when the roll winding 100 is rotated in the opposite direction. The screen 200 may be made of fabric, but is not limited thereto. The screen 200 may be made of various flexible materials.

The weight 300 is connected to the lower end of the screen 200. As shown in FIG. 1, the weight 300 is connected to the lower end of the screen 200, so the screen 200 can be unrolled. The weight 300 has appropriate mass, so it transmits tension due to gravity to the screen 200, and the tension transmitted to the screen 200 can act as a rotational force (torque) that rotates the winding roll 100. That is, the weight 300 is connected to the lower end of the screen 200, so it applies torque (rotational force) to the winding roll 100 in a first direction in which the screen 200 is unwound by gravity. The weight 300 may be formed in a bar shape having a length corresponding to the width of the screen 200, but it may be formed in other various shapes.

The elastic member 400 applies torque in a second direction in which the screen 200 is wound, by applying elasticity to the winding roll 100. The elastic member 400 may be disposed in the winding roll 100, as shown in FIG. 2. That is, since the elastic member 400 is provided, torque is applied to the winding roll 100 in the opposite direction to the first direction in which the weight 300 applies torque, so the winding roll 100 can be balanced. The elastic member 400 may be a torsional elastic body that keeps elastic energy by elastically deforming with rotation of the winding roll 100, and the torsional elastic body may be a coil spring fitted on the outer side of the rotary shaft. For example, as shown in FIG. 2, the elastic member 400 that is a torsional elastic body may be a coil spring fitted on the outer side of the rotary shaft 120, as shown in FIG. 2.

The more the winding roll 100 is rotated, the larger the deformation of the elastic member 400, and accordingly, the larger the restoring force. The restoring force acts in the opposite direction to the rotation causing the deformation, so it generates a rotational force in the opposite direction. For example, when the screen 200 is unwound, as the winding roll 100 is rotated in the unwinding direction, the rotational force in the opposite direction, that is, a winding direction (the second direction described above) is increased by elasticity. Further, since the length of the screen 200 increases when the screen 200 is unwound, the rotational force in the unwinding direction (the first direction described above) due to gravity is also increased by the sum of the weights of the weight 300 and the screen 200. Accordingly, the first-directional rotational force (torque) and the second-directional rotational force (torque) are increased while maintaining equilibrium. By the equilibrium of the rotational forces, it is possible to simply rotate the winding roll 100 and easily stop the winding roll 100 at a rotated position. Detailed operation will be described in more detail below.

The elastic member 400 is disposed between the rotary shaft 120 and the winding roll 100 and can generate torque. The elastic member 400, for example, may be coupled to the winding roll 100 through a rotary block that is coupled to the winding roll 100 to rotate. The rotary shaft 120 extends to the inside of the winding roll 100, and a rotary block 410 that is coupled to the winding roll 100 to rotate with the winding roll 100 may be formed in the winding roll 100. The elastic member 400, as shown in FIG. 3, may have both ends respectively connected and fixed to sides of the rotary block 410 and the rotary shaft 120. The rotary shaft 120 may pass through the rotational center of the rotary block 410, and a holder 411 formed around the outer side of the rotary block 410 is fitted on a guide rail (see 101 in FIGS. 2 and 3) on the inner side of the winding roll 100, so the winding roll 100 and the rotary block 410 can be rotated together.

According to this structure, when the winding roll 100 is rotated, the rotary block 410 is also rotated and the end, which is connected to the rotary block 410, of the elastic member 400 can be twisted and deformed. The rotary shaft 120 rotatably supports the winding roll 100, but does not rotate by itself, so the other end, which is fixed to the rotary shaft 120, of the elastic member 400 is maintained fixed. Accordingly, torsion is generated between an end and the other end of the elastic member 400, whereby elastic energy is stored. The elastic member 400 can be configured in this way. However, the configuration of the elastic member 400 is not limited thereto and the elastic member 400 may be configured in other ways that can apply a rotational force by applying elasticity to the winding roll 100.

The rotary shaft 120 may be coupled and fixed to the fixing bracket 620. A fixing portion **120*b* having various shapes may be formed and firmly fixed at the end, which faces the fixing bracket 620, of the rotary shaft 120. For example, the fixing portion 120*b* may be formed in various ways by compounding various fixing structures such as a fitting structure of a projection and a hole or a thread-fastening structure. Further, a rotary ring 120*a* is rotatably fitted on the circumference of the rotary shaft 120, and, as shown in FIG. 3, may be coupled to an end of the winding roll 100. Accordingly, the winding roll 100 can be supported by the rotary ring 120*a*** to rotate.

The holder 411 of the rotary block 410 may be slidably coupled to the guide rail (see 101 in FIG. 2) disposed in the winding roll 100. Accordingly, the rotary block 410 can horizontally move while rotating with the winding roll 100. The guide rail 101 extends in parallel with the rotary shaft 120, thereby being able to guide the sliding in parallel with the rotary shaft (see FIGS. 5 and 6). Accordingly, the rotary block 410 can easily cope with the length of the elastic member 400, which contracts or stretches, by horizontally moving in the longitudinal direction of the rotary shaft 120 while rotating. Therefore, it is possible to achieve a structure that more flexibly cope with elastic deformation.

Hereafter, the power conversion module is described in more detail with reference to FIGS. 1 to 4.

Figure 4:
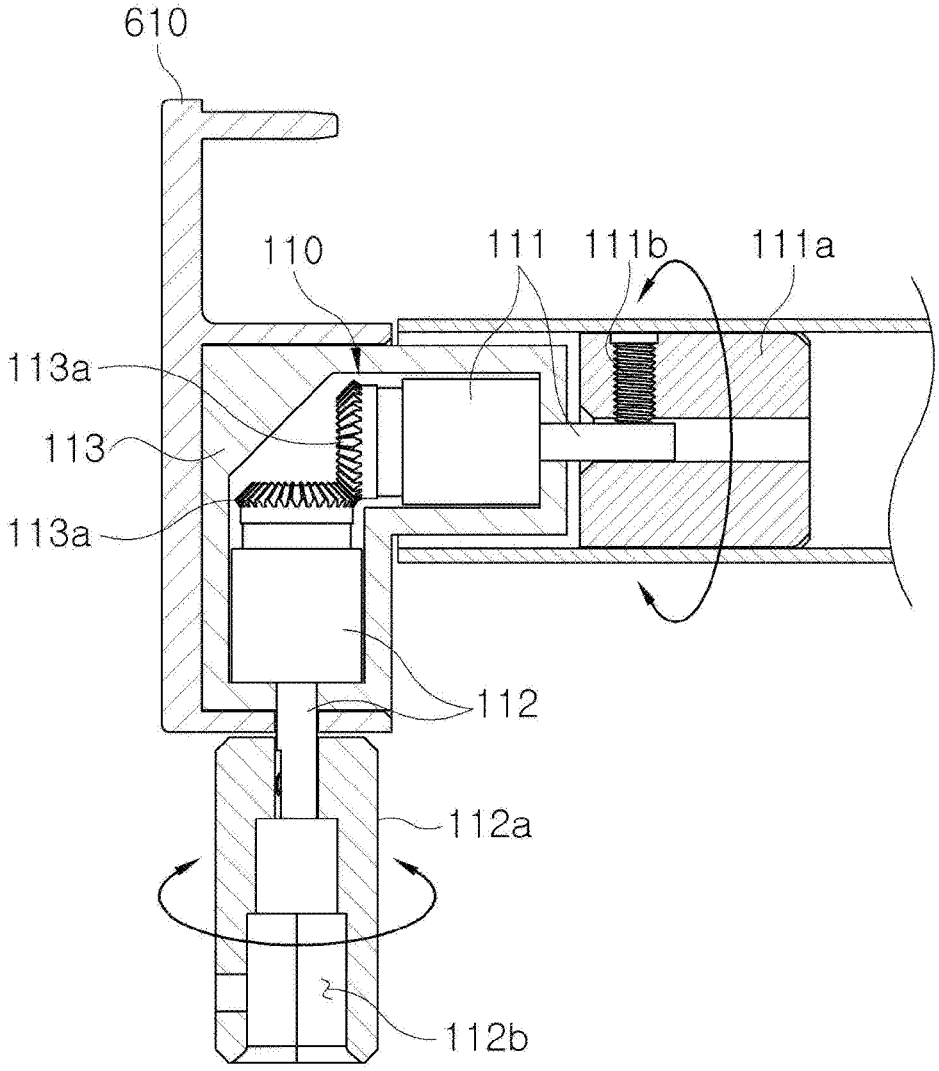
FIG. 4 is a cross-sectional view showing the internal structure of a fixing bracket of the cordless blind device shown in FIG. 1.

FIG. 4 is a cross-sectional view showing the internal structure of a fixing bracket of the cordless blind device shown in FIG. 1.

The power conversion module 110 is, as described above, disposed in the fixing bracket 610. The power conversion module 110, as shown in FIGS. 2 and 4, may be disposed in one, which is not connected with the rotary shaft 120, of the fixing brackets 610 and 620 at both ends of the winding roll 100. The power conversion module 110 includes the first driving shaft 111 connected to the winding roll 100 and the second driving shaft 112 connected to the external driving device connector 112*a*. The gear box 113 is disposed between the first driving shaft 111 and the second driving shaft 112 and transmits power in two directions between them. The first driving shaft 111, as shown in the figures, is coaxially disposed with the winding roll 100, and the second driving shaft 112 extends downward from the fixing bracket 610. That is, the first driving shaft 111 and the second driving shaft 112 may not be in parallel with each other and may transmit power not in parallel with each other by the power transmission structure of the gear box 113.

The first driving shaft 111 and the second driving shaft 112 particularly perpendicularly cross each other. In order to easily transmit a driving force between the driving shafts perpendicular to each other, the gear box 113 may include a pair of bevel gears 113*a* engaged between the first driving shaft 111 and the second driving shaft 112. That is, the first driving shaft 111 is disposed at the rotational center of the winding roll 100 in parallel with the winding roll 100, and the second driving shaft 112 is connected perpendicularly thereto through the bevel gears 113*a* and can transmit power. Accordingly, external power is provided to the first driving shaft 111 through the second driving shaft 112, whereby the winding roll 100 connected to the first driving shaft 111 can be conveniently rotated. Since the second driving shaft 112, as described above, extends downward from the fixing bracket 610 and has the driving device connector 112*a* at the end, it is possible to easily connect a driving device to the second driving shaft 112 extending downward and the driving device connector at the end and to operate the blind device even if the blind device is installed relatively high.

That is, the power conversion module 110 has a structure that can transmit power in two directions by connecting the horizontally disposed first driving shaft 111 and the second driving shaft 112 disposed perpendicular to the first driving shaft 111. The gear box 113 may be used to transmit a driving force between the different driving shafts. The gear box 113 particularly includes the pair of bevel gears 113*a* rotating in mesh with each other, so it can freely transmit both forward and rearward rotation between the driving shafts perpendicular to each other from the winding roll 100 to the power conversion module 110 or from the power conversion module 110 to the winding roll 100.

That is, as shown in FIG. 4, the driving device connector 112*a* and the second driving shaft 112 connected to the driving device connector 112*a* can rotate both forward and rearward, and a rotational force is transmitted through the pair of bevel gears 113*a* engaged with each other, so the first driving shaft 111 can rotate both forward and rearward. Accordingly, the winding roll 100 connected to the first driving shaft 111 can be rotated both forward and rearward (i.e., the winding direction and the unwinding direction). That is, when an external driving device is connected to the driving device connector 112*a* and the second driving shaft 112 is rotated, a rotational force is transmitted to the winding roll 100, so the blind device can be driven. As shown in the figures, the driving device connector 112*a* has a tool insertion groove 112*b* recessed coaxially with the second driving shaft 112, so it can be easily combined with an external driving device by putting a driving shaft of the driving device into the tool insertion groove 112*b*. The tool insertion groove 112*b* may not necessarily mean a groove for inserting a tool, and may be a groove in which common tools are coupled to be able to rotate the second driving shaft 112 using the common tools. Accordingly, even though it is referred as a tool insertion groove 112*b*, but it may be a special groove in which only a dedicated driving device is coupled.

Further, on the contrary, when a user directly touches and operates the blind device, the winding roll 100 may be rotated first and then the power conversion module 110 is correspondingly rotated. That is, when the winding roll 100 is rotated, the first driving shaft 111 connected to the winding roll rotates in the corresponding direction and a rotational force is transmitted backward through the bevel gears 113*a* engaged with each other, so the second driving shaft 112 can also be rotated in the corresponding direction. In this case, friction is generated in the power conversion module 110 while the rotational force is transmitted, so resistance that offsets the resultant force of the torque applied in the first direction and the torque applied in the second direction can be generated. Accordingly, the screen 200 can be stably maintained at various heights while more precisely maintaining balance. As described above, it is possible not only to rotate the winding roll 100 using the power conversion module 110 and external power, but also to more precisely balance the blind device, which is operated without a cord, using the resistance generated in the power conversion module 110.

The tool insertion groove 112*b* of the driving device connector 112*a*, for example, may be a recessed polygonal groove. It is possible to transmit a driving force by inserting a driving shaft having a polygonal outer side of an external driving device into the tool insertion groove 112*b*. That is, it is possible to rotate the second driving shaft 112 by detachably coupling an external driving device having a polygonal driving shaft to the driving device connector 112*a*, and as described above, a rotational force can be transmitted to the first driving shaft 111 through the bevel gears 113*a* engaged with each other. The first driving shaft 111 may be inserted and fixed in a connection block 111*a* having an end connected in the winding roll 100. The connection block 111*a*, as shown in the figures, may be a block filling the inside of the winding roll 110, and may be inserted in the winding roll 100 and rotated with the winding roll 100. The connection block 111*a* may have a groove on the outer surface and may be coupled to a protrusion on the inner surface of the winding roll 100, thereby being able to be synchronized with the winding roll 100 in rotation. It is possible to fix the first driving shaft 111 to the connection block 111*a* through pressure of a fixing screw 111*b* by fastening the fixing screw 111*b* to the connection block 111*a*. However, the present invention is not limited thereto, and the connection structure for connecting the first driving shaft 111 and the winding roll 100 may be changed in various types.

The gear box 113 has a box-shaped structure through which the first driving shaft 111 and the second driving shaft 112 protrude from the ends, and the bevel gears 113*a* connecting the first driving shaft 111 and the second driving shaft 112 are disposed therein. The gear box 113 connects the first driving shaft 111 and the second driving shaft 112 through the pair of bevel gears 113*a* disposed therein. The end connected to the first driving shaft 111 of the gear box 113 is inserted in the winding roll 100, and the other end connected to the second driving shaft 112 is positioned in the fixing bracket 610. The gear box 113, for example, has an L-shaped bending structure, thereby being able to maintain the arrangement of the driving shafts (the first driving shaft 111 and the second driving shaft 112) perpendicular to each other and to connect the winding roll 100 and the fixing bracket 610 to each other. As described above, the first driving shaft 111 is connected with the connection block 111*a* in the winding roll 100, thereby being able to be synchronized in rotation with the winding roll 100. In particular, the magnitude of the resistance described above can be adjusted by adjusting the gap between the gears in the gear box 113. For example, it is possible to adjust the engagement strength by adjusting the gap between the bevel gears 113*a* connecting the first driving shaft 111 and the second driving shaft 112 to each other in the gear box 113, whereby it is possible to appropriately change the magnitude of the resistance generated in the power conversion module 110. Therefore, by appropriately changing the magnitude of the resistance, it is possible to easily find a balance point and more easily maintain the screen 200 at various positions.

Hereafter, the operation process of the cordless blind device is described in more detail with reference to FIGS. 5 to 7.

Figure 6A:
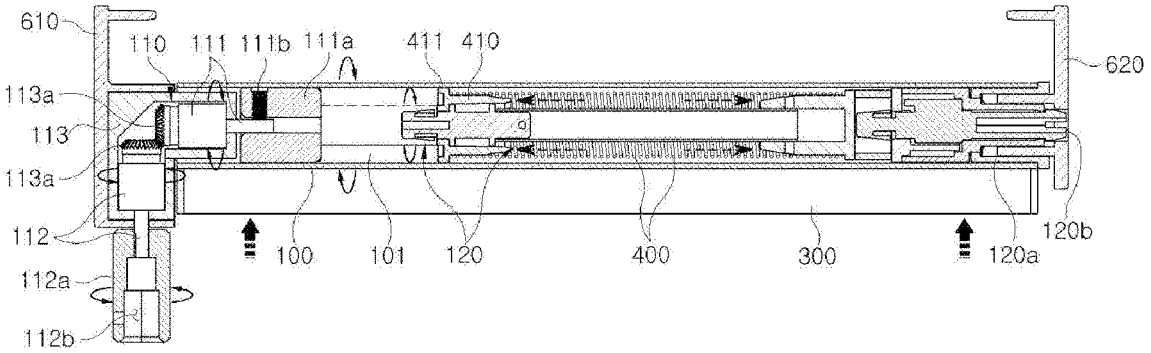
Figure 6B:
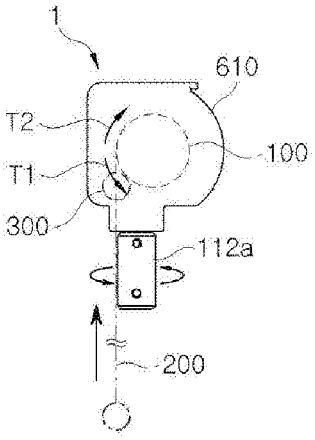
Figure 7:
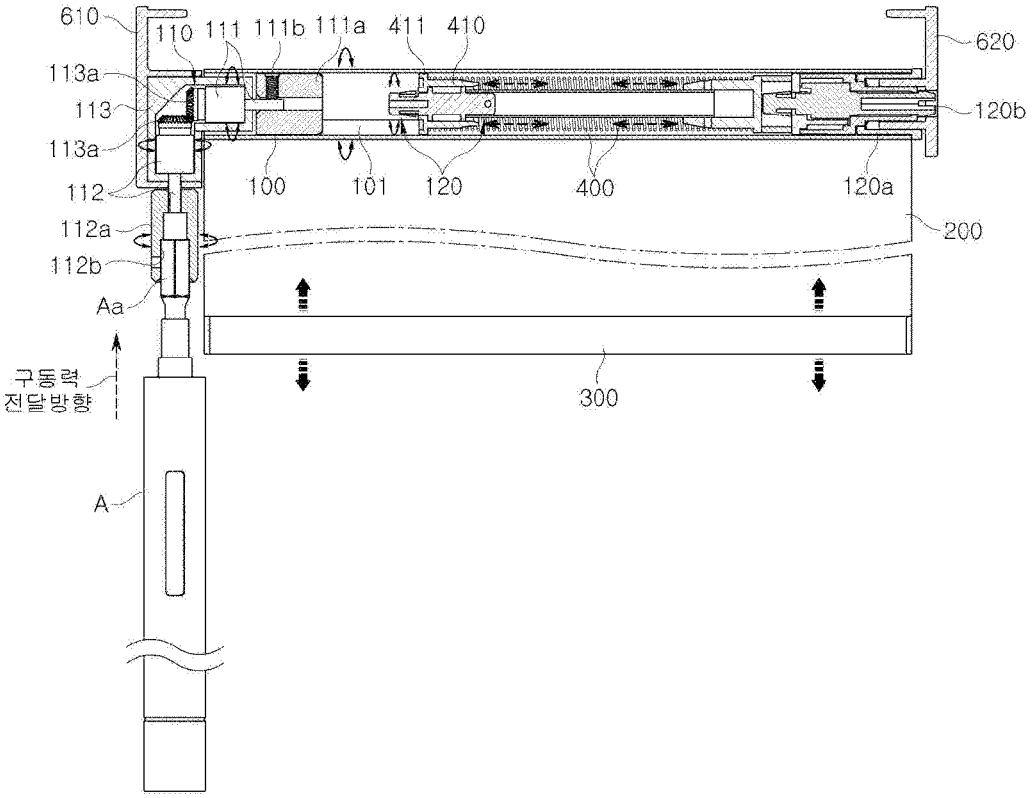
FIG. 7 is a view showing the operation of the blind device shown in FIG. 1 using external power.

FIGS. 5 and 6 are views showing the operation of the blind device shown in FIG. 1 by directly moving up/down the screen and FIG. 7 is a view showing the operation of the blind device shown in FIG. 1 using external power.

The cordless blind device 1 can be very easily operated even without a cord because of the structural characteristic. The weight 300 applies torque (see T1 in FIGS. 5 and 6) to the winding roll 100 in the first direction in which the screen 200 is unwound, and the elastic member 400 correspondingly applies torque (see T2 in FIGS. 5 and 6) in the second direction in which the screen 200 is wound. Accordingly, it is possible to maintain balance of the winding roll 100 at various rotated positions, and it is possible to more easily keep the winding roll 100 stopped using the friction force generated by a friction fixing portion 500.

That is, it is possible to easily break the balance and adjust the length of the screen 200 by applying a minimum external force (for example, simply touching the screen or the weight) to the cordless blind device 1 using the torque (T1 and T2) acting in opposite directions while increasing or decreasing in accordance with the unwound length of the screen 200. Further, it is possible to easily return to the balanced status by removing the external force, whereby it is possible to maintain the changed length of the screen 200. Even if subtle unbalance is generated between the applied torque T1 and T2, the resultant force of the torque T1 and T2 applied in opposite directions is offset by the resistance of the power conversion module 110 generating resistance while rotating together, so the stopped status can be more easily maintained.

Figure 5A:
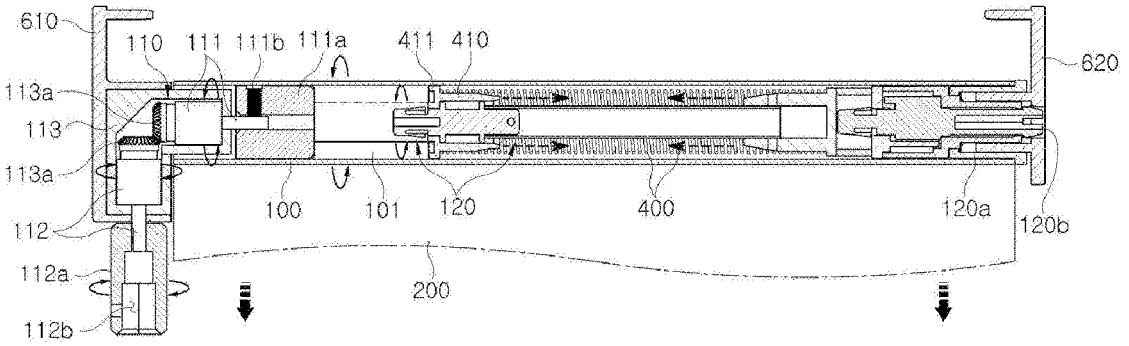
FIGS. 5A-5B and 6A-6B are views showing the operation of the blind device shown in FIG. 1 by directly moving up/down the screen.
Figure 5B:
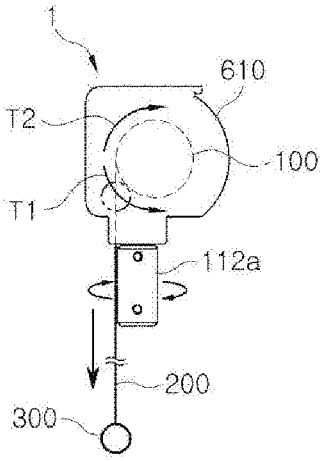

For example, the screen 200 may be unwound, as shown in FIG. 5B. In this case, the winding roll 100 rotates, as shown in FIG. 5A, and accordingly, the rotary block 410 coupled to the winding roll 100 also rotates. Accordingly, the elastic member 400 connected to the rotary block 410 stores elastic energy while deforming. The elastic member 400 deforms to correspond to the unwound length of the screen 200, so a restoring force is increased. The restoring force acts as the second-directional torque T2, as shown in FIG. 5B.

Further, the first-directional torque T also increases. In addition to the load of the weight 300, load corresponding to the unwound length of the screen 200 increases, so the effect of gravity increases. Accordingly, the tension in the screen 200 is increased by gravity and the increased tension acts as the first-directional torque T1. The first-directional torque T1 is generated in the completely opposite direction to the second-directional torque T2, so balance can be maintained. It may be possible to adjust the first-directional torque T1 and the second-directional torque T2 such that the magnitudes become the same by adjusting the elastic modulus of the elastic member 400 or the load of the weight 300.

In this case, as shown in FIG. 5A, the power conversion module 110 connected to the winding roll 100 is rotated by the rotational force from the winding roll 100 and generates resistance due to friction. The resistance acts on the winding roll 100 and keeps the winding roll 100 stopped. Since the power conversion module 110 has the gear engagement structure described above therein, resistance can be more effectively generated by friction. Even if there is a subtle difference between the magnitudes of the first-directional torque T1 and the second-directional torque T2, the resistance transmitted to the winding roll 100 removes the difference and maintains a stopped status. That is, even if there is a remaining resultant force of the first-directional torque T1 and the second-directional torque T2 applied in opposite directions, it is offset by the resistance generated in the power conversion module 110, so a stopped status can be effectively maintained.

This action is performed in accordance with the same principle also in the case when the screen 200 is wound, as shown in FIGS. 6A-6B. As shown in FIG. 6B, when the screen 200 is wound, the winding roll 100 is rotated in the opposite direction as shown in FIG. 6A, the elastic member 400 returns to the initial shape while decreasing in deformation, the stored elastic energy decreases, and the restoring force also decreases. Accordingly, the second-directional torque T2 correspondingly decreases. Further, the unwound length of the screen 200 decreases and only the load of the weight 300 acts downward, so the first-directional torque T1 applied to the winding roll 100 also correspondingly decreases. In addition, since the driving shafts of the power conversion module 110 generate resistance using friction while rotating in opposite directions, the first-directional torque T1 and the second-directional torque T2 are equilibrated and resistance acts, whereby the winding roll 100 can be kept stopped.

That is, regardless of winding or unwinding of the screen 200, first-directional torque T1 and the second-directional torque T2 increase or decrease while maintaining equilibrium. Further, since the power conversion module 110 generates resistance by operating with rotation of the winding roll 100, it is possible to more easily stop the winding roll 100. A user can easily adjust the length of the screen 200 by providing only a minimum external force that can break the equilibrium, and can maintain a predetermined length at a desired position by breaking the equilibrium. This operation can be very easily performed only by simply touching and moving up or down the screen 200 or the weight 300 connected to the screen 200. As described above, it is possible to achieve a convenient use environment using the cordless blind device 1 of the present invention.

On the other hand, as shown in FIG. 7, the cordless blind device 1 can be driven using an external driving device A. It is possible to transmit a driving force from the driving device A to the cordless blind device 1 by connecting the driving device A to the power conversion module 110 by coupling a driving shaft Aa of the driving device A into the tool insertion groove 112*b* of the driving device connector 112*a*. In this case, as described above, a rotational force is transmitted to the first driving shaft 111 through the bevel gears 113*a* from the second driving shaft 112, and accordingly, the winding roll 100 connected to the first driving shaft 111 can be rotated by the driving force of the external driving device A. In particular, as shown in the figures, by simply coupling the external driving device A to the driving device connector 112*a* of the second driving shaft 112 extending downward, it is possible to very conveniently operate the blind device even if the blind device is installed relatively high. The driving device A is separably coupled to the driving device connector 112*a*, so it may function as a power generation device providing a rotational driving force to the second driving shaft, that is, an electric driving device such as an electric tool. However, the present invention is not limited thereto, and for example, various rotation transmission devices that are used for a manual hand drill may be used.

As described above, since both forward and rearward rotation can be easily transmitted to the winding roll 100 through the engagement structure of the bevel gears 113*a*, it is possible to very conveniently wind or unwind the screen 200 using the driving force of the external driving device A. As described above, it is possible to very conveniently operate the cordless blind device 1 of the present invention.

Although exemplary embodiments of the present invention were described above with reference to the accompanying drawings, those skilled in the art would understand that the present invention may be implemented in various ways without changing the necessary features or the spirit of the prevent invention. Therefore, the embodiments described above are only examples and should not be construed as being limitative in all respects.

INDUSTRIAL APPLICABILITY

Since the cordless blind device for external power drive of the present invention is operated without a cord, it is possible to remarkably reduce the possibility of a negligent accident due to a cord. Further, since the cordless blind device can be operated by power provided from the outside using a separate tool, if necessary, it is possible to conveniently operate the screen even at a height that is not reached by a hand. Further, since it is possible to operate the screen using common electric tools that are generally used at home, it is possible to achieve a blind device that is electrically operated without a specific cost. Further, since it is possible to use simple manual tools in addition to electric tools, it is possible to conveniently operate the entire blind device without a cord. Further, since there is no cord, the blind device can be safely used and can be conveniently operated by external power from various external devices, depending on cases, thereby securing common use and adaptability and increase industrial applicability.

REFERENCE SIGNS LIST

1: cordless blind device
100: winding roll
110: power conversion module
111: first driving shaft
111*a*: connection block
111*b*: fixing screw
112: second driving shaft
112*a*: driving device connector
112*b*: tool insertion groove
113: gear box
113*a*: bevel gear
101: guide rail
120*a*: rotary ring
120*b*: fixing portion
120: rotary shaft
200: screen
300: weight
400: elastic member
410: rotary block
411: holder
610, 620: fixing bracket
T1: first-directional torque
T2: second-directional torque
A: driving device

The invention claimed is:

1. A cordless blind device for external power drive, comprising:

a winding roll rotatably coupled to a pair of fixing brackets disposed at both ends thereof;

a screen configured to be wound on or unwound from the winding roll;

a weight connected to a lower end of the screen and applying torque in a first direction, the screen being unwound in the first direction from the winding roll by gravity;

an elastic member applying torque in a second direction, the screen being wound in the second direction by applying elasticity to the winding roll; and a power conversion module disposed in at least one of the pair of fixing brackets and including a first driving shaft connected to the winding roll, a second driving shaft connected with a driving device connector, and a gear box connecting the first driving shaft and the second driving shaft, and configured for transmitting power in two directions, wherein the second driving shaft is disposed in perpendicular to the first driving shaft, and wherein the driving device connector includes a tool insertion groove recessed coaxially with the second driving shaft, such that an external driving device configured to provide a rotational force is to be detachably coupled to the driving device connector through the tool insertion groove to transmit the rotational force to the second driving shaft.

2. The cordless blind device of claim 1, wherein the first driving shaft is coaxially disposed with the winding roll and the second driving shaft extends downward from the gear box.

3. The cordless blind device of claim 1, wherein the gear box includes a pair of bevel gears.

4. The cordless blind device of claim 1, wherein the gear box has an end connected to the first driving shaft and another end connected to the second driving shaft, the end of the gear box being inserted in the winding roll, and the another end of the gear box being positioned in the at least one of the pair of fixing brackets.

5. The cordless blind device of claim 1, wherein the gear box is configured to generate resistance that offsets a resultant force of torque applied to the winding roll in the first direction and torque applied to the winding roll in the second direction.

6. The cordless blind device of claim 5, wherein magnitude of the resistance is adjusted by adjusting a gap between gears in the gear box.

7. The cordless blind device of claim 1, wherein the elastic member is a torsional elastic member storing elastic energy by elastically deforming with rotation of the winding roll.

8. The cordless blind device of claim 7, wherein the torsional elastic member is a coil spring fitted on an outer side of a rotary shaft connected to the winding roll.

* * * * *